US007250828B2

(12) United States Patent
Erb

(10) Patent No.: US 7,250,828 B2
(45) Date of Patent: Jul. 31, 2007

(54) COMPACT BALUN

(75) Inventor: Jean-Luc Erb, Horbourg-Wihr (FR)

(73) Assignee: TDK Corporation, Tokyo (JP)

( * ) Notice: Subject to any disclaimer, the term of this patent is extended or adjusted under 35 U.S.C. 154(b) by 59 days.

(21) Appl. No.: 11/080,478

(22) Filed: Mar. 16, 2005

(65) Prior Publication Data

US 2006/0208824 A1 Sep. 21, 2006

(51) Int. Cl.
*H01P 5/10* (2006.01)
*H01P 5/02* (2006.01)

(52) U.S. Cl. ..... 333/26; 333/24 R

(58) Field of Classification Search ..... 333/25, 333/26, 24 R

See application file for complete search history.

(56) References Cited

U.S. PATENT DOCUMENTS

| | | | | |
|---|---|---|---|---|
| 5,949,299 | A | 9/1999 | Harada | 333/25 |
| 6,292,070 | B1 | 9/2001 | Merrill | 333/26 |
| 6,294,965 | B1 | 9/2001 | Merrill et al. | |
| 6,396,362 | B1 | 5/2002 | Mourant et al. | |
| 6,396,632 | B1 | 5/2002 | Liu et al. | 359/579 |
| 6,426,683 | B1 | 7/2002 | Gu et al. | |
| 6,819,199 | B2 | 11/2004 | Burns et al. | 333/26 |
| 6,844,792 | B1 * | 1/2005 | Koeppe et al. | 333/24 R |
| 7,034,630 | B2 * | 4/2006 | Rijks | 333/26 |

FOREIGN PATENT DOCUMENTS

| | | |
|---|---|---|
| EP | 1 100 193 A2 | 5/2001 |

* cited by examiner

*Primary Examiner*—Dean Takaoka
(74) *Attorney, Agent, or Firm*—Oliff & Berridge, PLC

(57) ABSTRACT

A distributed backwards-wave balun comprising first and second pairs of coupled transmission line sections having one line section of the first coupled pair connected in series with one line section of the second coupled pair. A differential port is connected across the outer ends of the series-connected line sections and a single-ended port is connected to the inner end of the other line section of one of the coupled pairs. The balun includes an inductive load, connected in parallel with the differential port, in which the electrical length of the coupled line sections is less than one quarter of the wavelength of the centre frequency of the operating band of the balun.

6 Claims, 5 Drawing Sheets

COMPACT BALUN

BACKGROUND

This invention relates to a distributed backwards-wave balun for use, for example, in wireless, cellular handsets and radios, and in RF modules therefor.

Differential circuits have been employed in wireless cellular communications handsets and other wireless technologies for many years. The benefits from using differential circuits are lower noise and lower susceptibility to interference. Despite the benefits of differential circuits, some of the components used in a modern wireless communications technologies remain single ended; for example, single ended antennae are more common than differential antennae, and similarly it is often preferred to employ single ended power amplifiers. In cases where wireless communications technologies share single-ended and differential components, it is necessary to include devices which convert the unbalanced signals which are output from the single ended components to balanced signals which can be fed to the inputs of the differential components and vice versa.

Such devices are often referred to as baluns. A balun transforms a signal referenced to ground into two signals with equal amplitude and opposite phase. Figures of merit for describing the electrical characteristics of a balun are the amplitude and phase balance and the return loss and insertion loss.

A balun can be implemented by a number of discrete components. Balun topologies employing discrete components are described in U.S. Pat. Nos. 5,949,299 and 6,396,632. Baluns can also be implemented using distributed components; such baluns normally employ a number of half- or quarter-wavelength coupled transmission lines. A popular form of the distributed balun is described in N. Marchand: "Transmission Line Conversion Transformers", Electronics, vol. 17, pp 142-145, 1944 and is often referred to as a Marchand balun after the inventor. An alternative distributed balun is described in U.S. Pat. No. 06,292,070 and is often referred to as a backwards-wave balun. The structure of a Marchand balun is depicted in FIG. 1*a*, and the structure of a backwards-wave balun is depicted in FIG. 1*b*.

In each case the balun comprises first and second pairs of coupled transmission line sections 10A, 10B and 12A, 12B respectively. Each of the line sections 10A, 10B and 12A, 12B has an electrical length E which is equal to one quarter of the wavelength of the centre frequency of the operating band of the balun. The electrical characteristics of the coupled transmission line sections 10A, 10B and 12A, 12B are described by the electrical length E, by the even mode admittance $Y_E$ and by the odd mode admittance $Y_O$ of the coupled line sections. The line sections 10A and 12A are connected in series. In the case of the Marchand balun (FIG. 1*a*) the differential port 14 is connected across the inner ends of the line sections 10B, 12B and the single-ended port 16 is connected to one outer end of the series-connected line sections 10A, 12A. In the case of the backwards-wave balun (FIG. 1*b*) the differential port 14 is connected across the outer ends of the series-connected line sections 10A, 12A and the single-ended port 16 is connected to the inner end of one of the line sections 10B, 12B. Such baluns are so well-known that no further description is deemed necessary.

Distributed baluns such as the Marchand balun and the backwards-wave balun offer excellent performance in the areas of amplitude balance, phase balance, return loss and insertion loss; they also have a much wider bandwidth than the discrete balun described in U.S. Pat. No. 5,949,299.

Distributed baluns can easily be implemented in multilayer substrates using, for example, LTCC (low temperature co-fired ceramic) technology, and offer greater flexibility in the layout than baluns which employ discrete components, such as those described in U.S. Pat. Nos. 5,949,299 and 6,396,632. For example, a distributed balun can be fabricated in a multilayer LTCC substrate such that the coupled lines are folded over several layers of LTCC and where the metal patterns on each layer are connected to those on higher or lower layers by electrically conducting via holes. This structure can substantially reduce the XY dimensions of the balun if a sufficient number of layers of LTCC are used. On the other hand, the coupled lines can be confined to the surface of a single layer of LTCC, thereby substantially reducing the height of the balun at the expense of increased size in the XY plane. Distributed baluns can readily be matched to a range of input and output impedances without the need for matching components.

As described above, conventional Marchand and backwards-wave baluns comprise 2 quarter-wave coupled-line sections. At 2.45 GHz, the centre frequency for 802.11 b/g Wireless-LAN standards, a quarter-wave transmission line, fabricated on a substrate with a dielectric permittivity of 8 (typical for LTCC), will have a length of 11 mm. For mobile cellular applications, a balun employing a pair of 11 mm coupled line sections is rather large, and it is difficult to incorporate such long lines into a multilayer substrate with dimensions similar to those which are possible with the discrete balun described in U.S. Pat. No. 5,949,299. However, the wider bandwidth which distributed baluns can offer is increasingly becoming a requirement as cellular handsets and wireless technologies are designed to offer higher rates of data transfer and to operate on wider bands or on a greater diversity of bands. Clearly, there exists a strong demand for a balun which combines the wide bandwidth of the distributed balun described in U.S. Pat No. 06,292,070, together with the small size of the discrete balun described in U.S. Pat. No. 5,949,299.

Gavela I., Falagan M. A., Fluhr H.; "A small size LTCC balun for Wireless Applications"; Proceedings of the European Microwave Conference 2004; pp 373-376 showed that capacitive loading can offer substantial size reduction of a Marchand balun. Gavela et al found that by connecting capacitive loads to the unbalanced input and to the open circuit end of the series coupled line sections of a Marchand balun, a size reduction of ~50% was possible.

U.S. Pat. No. 6,819,199 also discloses a compact Marchand balun. The size reduction of the balun of U.S. Pat. No. 6,819,199 is achieved through the use of multiple coupling or loading capacitors, as described on page 6, lines 42-51 of U.S. Pat. No. 6,819,199.

Marchand baluns have the drawback that the differential outputs are connected to ground via the grounded coupled lines. As a result, DC blocking capacitors are required if a DC bias is to be applied to the differential outputs of a Marchand balun—see FIG. 2*a*. A further drawback is that a pair of DC bias networks are required in order to apply a DC bias to both of the differential outputs—see also FIG. 2*a*.

On the other hand, a DC bias can be applied to the differential outputs of a backwards-wave balun without the need for DC blocking capacitors, because the differential outputs of the balun are isolated from ground—see FIG. 2*b*.

Furthermore, a DC bias can be applied to both differential outputs of a backwards-wave balun simultaneously by a single DC bias network—see also FIG. 2*b*.

SUMMARY

For the reasons given above, a size-reduced backwards-wave balun would have a wider range of applications in wireless communication technologies, compared with a size reduced Marchand balun.

Accordingly, the present invention provides a distributed backwards-wave balun comprising first and second pairs of coupled transmission line sections having one line section of the first coupled pair connected in series with one line section of the second coupled pair, a differential port connected across the outer ends of the series-connected line sections, and a single-ended port connected to the inner end of the other line section of one of the coupled pairs, the balun further including an inductive load connected to at least one terminal of the differential port, whereby the electrical length of at least one of the coupled line sections is less than one quarter of the wavelength of the centre frequency of the operating band of the balun.

The balun of the present invention maintains all of the benefits of conventional distributed baluns: design layout flexibility, wide bandwidth, and the ability to match the balun to a range of input and output terminating impedances.

In addition, a DC bias can be applied to both terminals of the differential port of the balun of the present invention by a single DC bias network.

The balun of the present invention further additionally requires no DC blocking capacitors if a DC bias is to be applied to the terminals of the differential outputs.

In the case where the inductive load connected to the at least one terminal of the differential port of the balun comprises a shunt inductor, the balun of the present invention has the additional benefit of offering protection of the differential circuit attached to the differential port of the balun from electrostatic discharge (ESD). In this case, DC blocking capacitors are required if a DC bias is to be applied to the terminals of the differential port of the balun.

Embodiments of the invention will now be described, by way of example, with reference to the accompanying drawings, in which:

DETAILED DESCRIPTION OF EMBODIMENTS

Figure 1A:
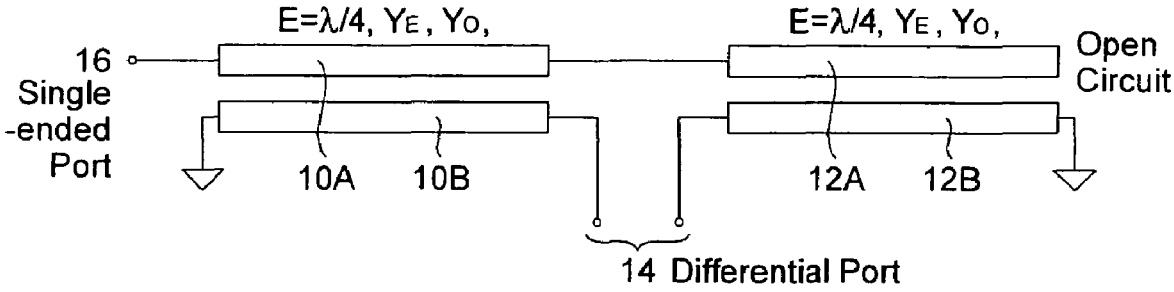
FIG. 1*a* (Prior Art) is a block diagram of a Marchand balun.
Figure 1B:
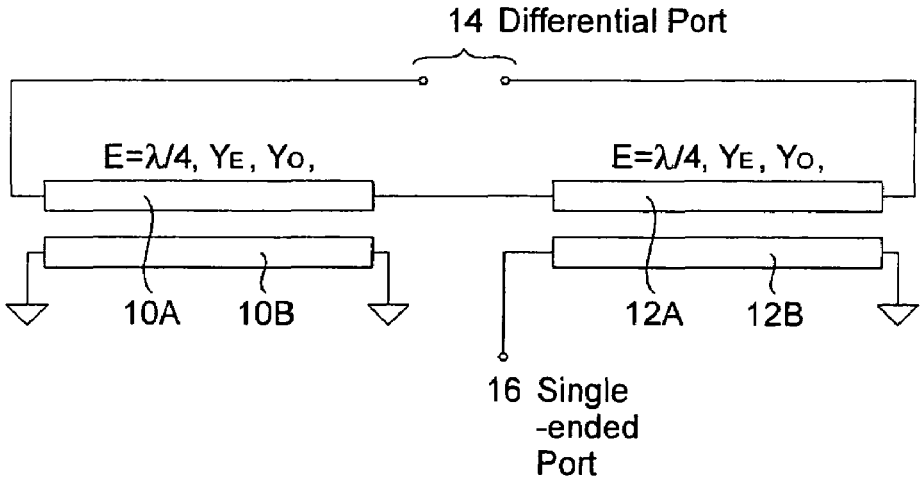
FIG. 1*b* (Prior Art) is a block diagram of a backwards-wave balun.
Figure 2A:
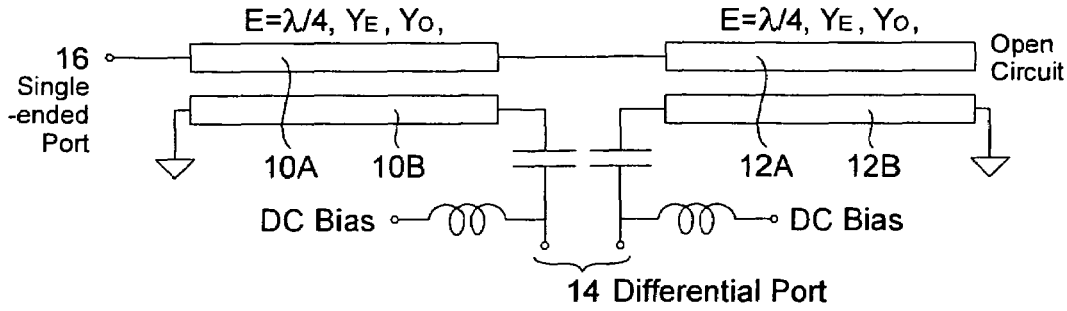
FIG. 2*a* (Prior Art) shows DC biasing of a Marchand balun.
Figure 2B:
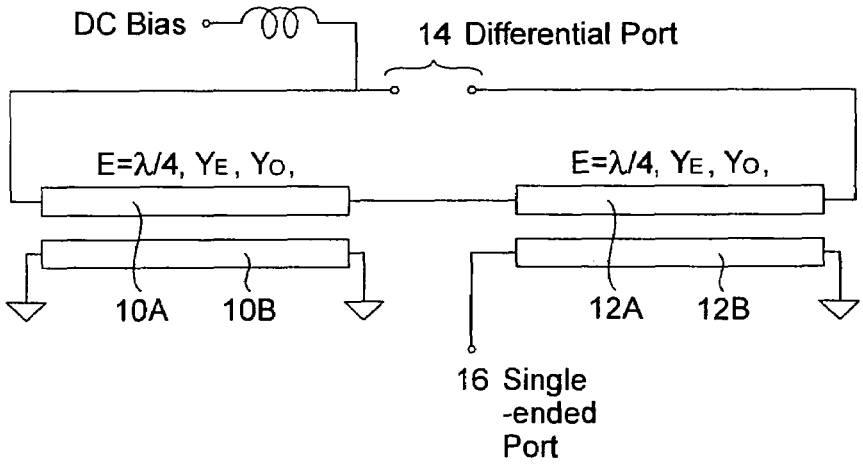
FIG. 2*b* (Prior Art) shows DC biasing of a backwards-wave balun.

In the drawings the same reference numerals have been used for the same or equivalent components in the various figures.

Figure 3:
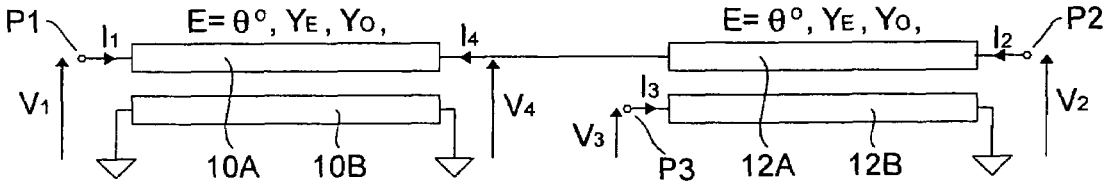
FIG. 3 shows an analysis of the currents and voltages at the non-grounded nodes of a backwards-wave balun.

A backward wave balun is depicted in FIG. 3. The balun shown in FIG. 3 can be analysed by writing down the Y-matrix for each of the coupled line sections 10A, 10B and 12A, 12B, and by noting that the electrical potential is zero at the ends of the coupled line sections which are connected to ground.

For this analysis, it is convenient to assume that two separate and identical single-ended terminations are connected to terminals P1 and P2 of the balanced port of the balun of FIG. 3, where $Y_B$ is the admittance of each of the single-ended terminations.

Analysis of the matrix equations 1a and 1b of Appendix A, show that the signals at the ports P1 and P2 of FIG. 3 will be equal in amplitude and will have a phase difference of 180°. Hence, the pair of signals at ports P1 and P2 can be described as a balanced signal.

Further analysis of the matrix equations 1a and 1b, gives rise to equations 2, 3a, 3b, 4a and 4b.

Equation 2 is an expression relating the even mode admittance $Y_E$, the odd mode admittance $Y_O$ and the phase of electrical length θ of the coupled line sections of the balun of FIG. 3 to the admittance $Y_B$ connected to each of the terminals P1 and P2 of the balanced port, and the admittance $Y_U$ presented by the balun at the unbalanced port P3.

Equation 3a shows that under particular conditions for the admittance $Y_B$ at the terminals P1 and P2 of the balanced port, and the admittance $Y_U$ which the balun presents at the unbalanced port P3, the imaginary part of the admittance $Y_B$ is negative. Hence, the optimum load at each terminal of the differential port of FIG. 3, is inductive.

Equation 4a shows that for particular values of the admittances $Y_B$ and $Y_U$, and the even mode and odd mode admittances $Y_E$ and $Y_O$ respectively, the phase of the electrical length θ of each of the coupled line sections of the backwards-wave balun of FIG. 3 is less than 90°, i.e. that the electrical length of the balun is less than one quarter of the wavelength of the centre frequency of the operating band of the balun. This is the required condition for size reduction.

Hence a size reduced backward-wave balun can be achieved by the addition of an inductive load at one or both of the terminals of differential port of the balun, where the inductive load comprises one or more series or shunt inductive elements. The exact arrangement of the inductive load depends on the impedance at the balanced port, the impedance which the balun is required to present at the unbalanced port, the even mode and odd mode admittances $Y_E$ and $Y_O$ of the coupled line sections of the balun, the layout of the balun and the application thereof.

Figure 4:
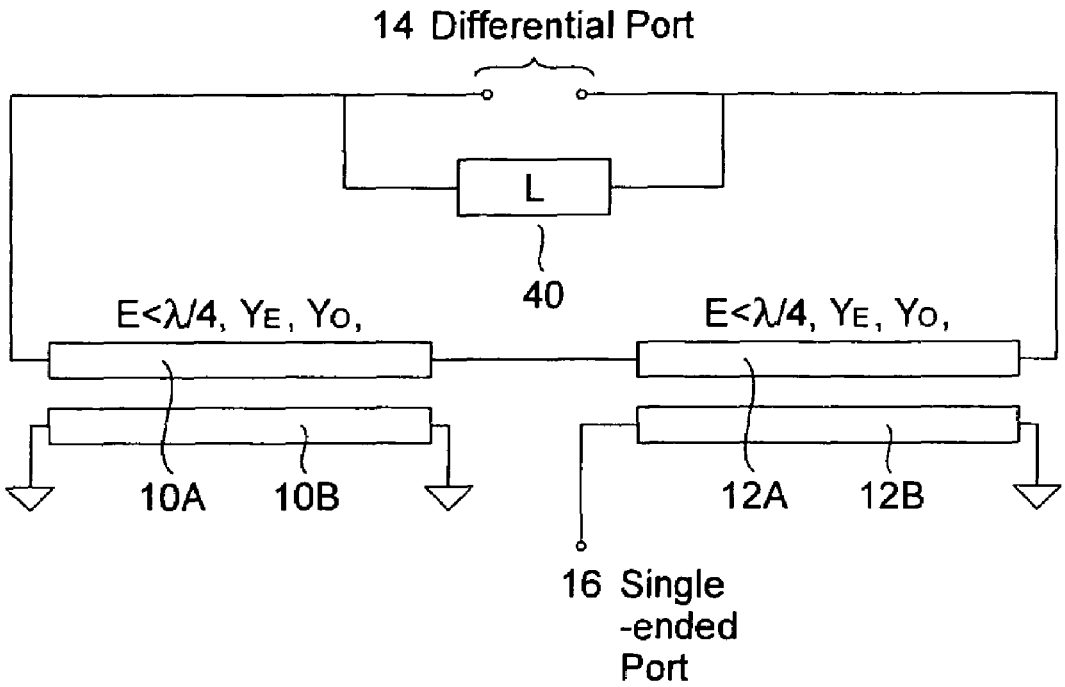
FIG. 4 is a block diagram of a first embodiment of a size-reduced backwards-wave balun employing parallel inductive loading according to the present invention.

FIG. 4 is a block diagram of a first embodiment of a backwards-wave balun according to the present invention. As shown, an inductive load 40 has been connected in parallel with the differential port 14 of the balun.

As described above, the inclusion of the inductive load 40, allows the electrical length E of each of the coupled line sections 10A, 10B, 12A, 12B of the backwards-wave balun of FIG. 4 to be less than one quarter of the wavelength of the centre frequency of the operating band of the balun.

Figure 5:
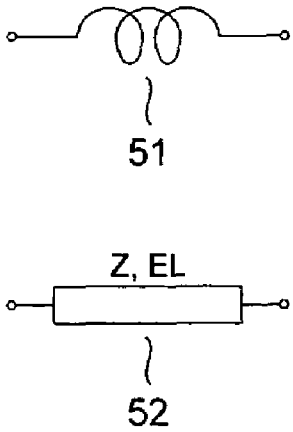
FIG. 5 shows possible configurations for the inductive loads of FIG. 4.

FIG. 5 shows two possible configurations for the inductive load 40 of FIG. 4. Thus, the inductive load can be either a lumped inductance 51 or a distributed element 52, with a characteristic impedance Z, and an electrical length EL.

Figure 6:
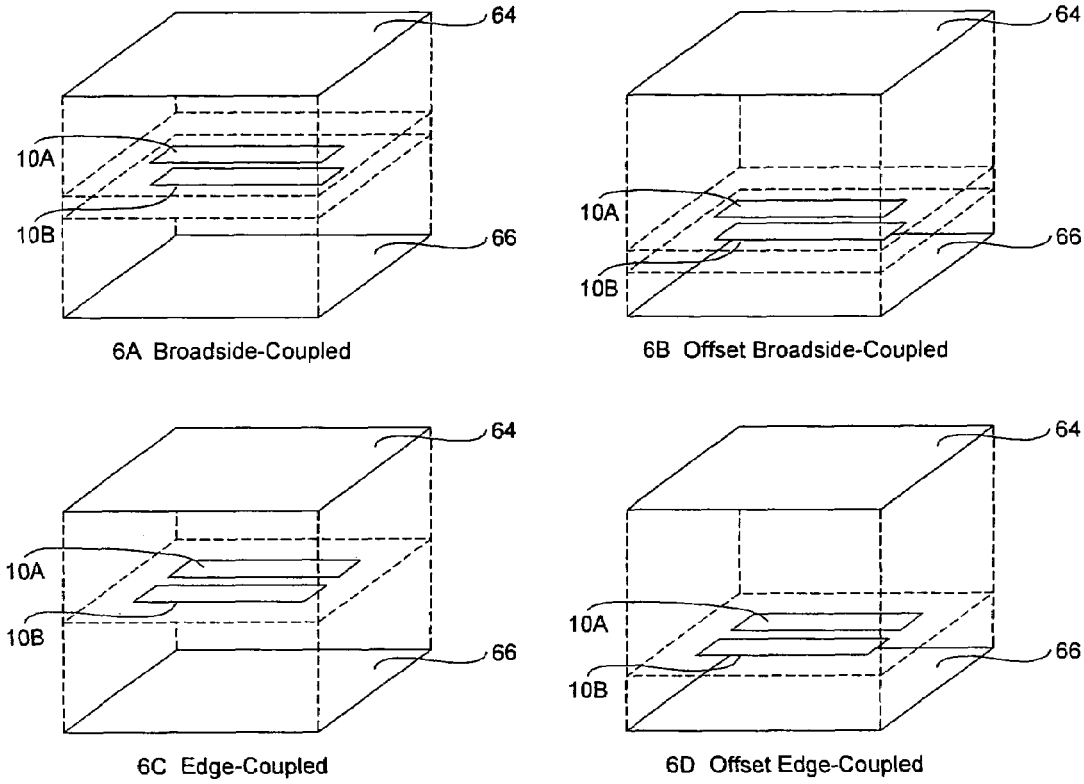
FIG. 6 shows possible configurations of the coupled-line sections of FIG. 4.

FIG. 6 shows a number of possible configurations for the pairs of coupled line sections of the embodiment of FIG. 4 (in FIG. 6 only the pair of line sections 10A, 10B is shown, but a similar arrangement will apply to the other pair of line sections 12A, 12B). The coupled line sections can be broadside-coupled as shown in 6A and 6B, or edge-coupled as shown in 6C and 6D. The coupled line sections can be symmetrically located between large area conductive shields 64, 66, as shown in 6A and 6C, or offset towards one of the shields as shown in 6B and 6D. It will be understood that the insulating layers of the microstrip or stripline structure are not shown in FIG. 6. The particular arrangement selected will depend on the desired values of the even- and odd-mode impedances of the coupled lines $Z_E$ and $Z_O$ which are important parameters in the design of a balun in accordance with the present invention. Ideally, the odd-mode admittance will be greater than 0.05 Siemens, which is equivalent to requiring strong coupling between the two lines of the coupled line sections. The even-mode admittance should be less than 0.02 Siemens.

Figure 7:
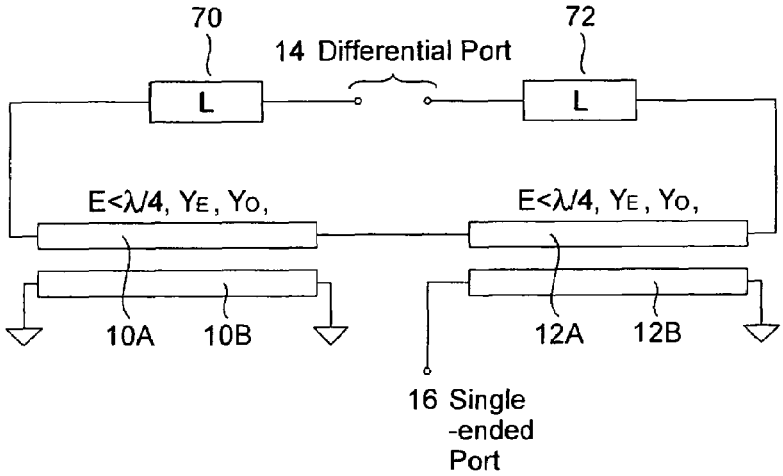
FIG. 7 is a block diagram of a second embodiment of the present invention employing series inductive loading.

FIG. 7 is a block diagram of a second embodiment of the backwards-wave balun of the present invention. In this case, respective inductive loads 70, 72 are connected in series with each terminals of the differential port 14. As shown in FIG. 5, each of the respective series inductive loads 70, 72 can be either a lumped inductance 51 or a distributed element 52, with a characteristic impedance Z, and an electrical length EL.

Figure 8:
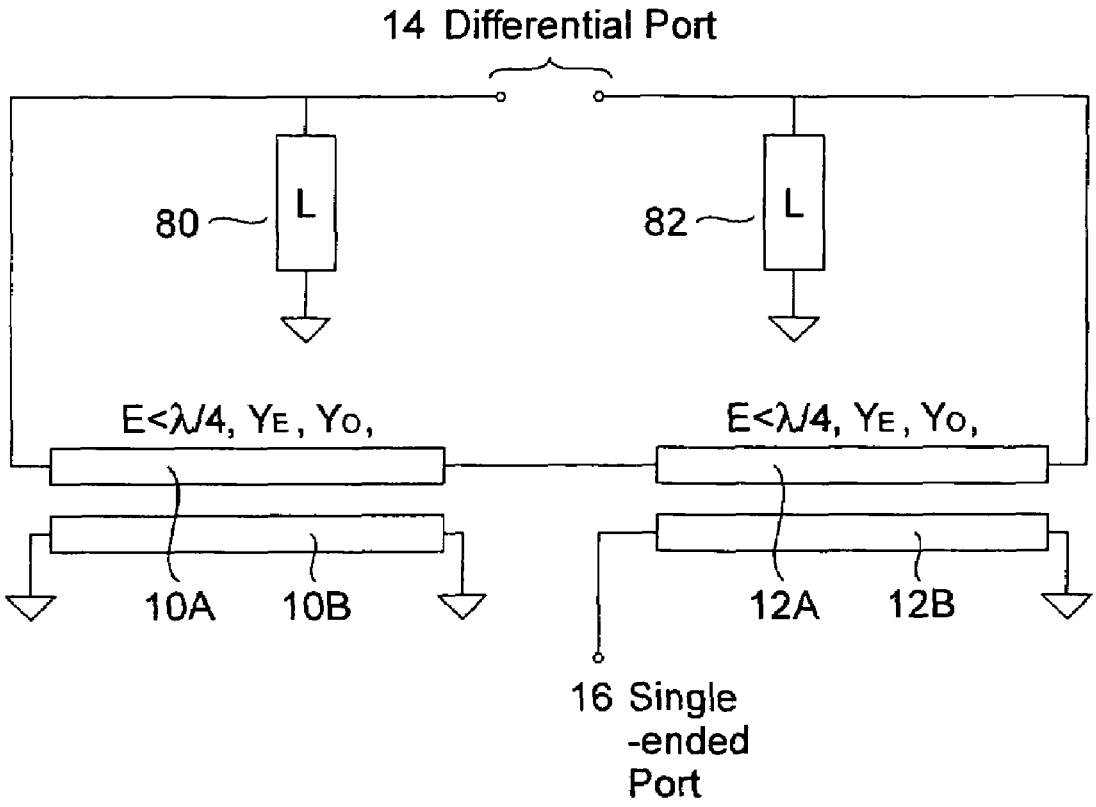
FIG. 8 is a block diagram of a third embodiment of the present invention employing shunt inductive loading.

FIG. 8 is a block diagram of a third embodiment of the backwards-wave balun of the present invention. In this case, respective shunt inductive loads 80, 82 have been connected at each terminal of the differential port. Once again, as shown in FIG. 5, each of the shunt inductive loads can be either a lumped inductance 51 or a distributed element 52, with a characteristic impedance Z, and an electrical length EL.

The preferred embodiments relate primarily to applications in wireless communication technologies which are fabricated on a multilayer carrier such as LTCC. However, the present invention is suitable for fabrication on a range of substrates, for example: FR4, PTFE, HTCC, thin-film on laminate, silicon, glass.

The invention is not limited to the embodiments described herein which may be modified or varied without departing from the scope of the invention.

Appendix A

FIG. 3 shows a circuit analysis of a backwards-wave balun, $Y_E$ and $Y_O$ are the even mode and odd mode admittances of the coupled line sections of FIG. 3 respectively and the angle θ is the phase length of each of the coupled line sections of FIG. 3 at the centre frequency of the operating band of the balun. The currents, $I_1$, $I_2$, $I_3$, and $I_4$ of FIG. 3, can be related to the voltages $V_1$, $V_2$, $V_3$, and $V_4$ by the following matrix equations.

$$\begin{pmatrix} I_1 \\ I_4 \end{pmatrix} = \frac{j}{2}\begin{pmatrix} -Y_\Sigma\cot\theta & Y_\Sigma\csc\theta \\ Y_\Sigma\csc\theta & -Y_\Sigma\cot\theta \end{pmatrix}\cdot\begin{pmatrix} V_1 \\ V_4 \end{pmatrix} \quad 1a$$

-continued $$\begin{pmatrix} I_2 \\ I_3 \\ I_4 \end{pmatrix} = \frac{j}{2}\begin{pmatrix} -Y_\Sigma\cot\theta & -Y_\Delta\csc\theta & Y_\Sigma\csc\theta \\ -Y_\Delta\csc\theta & -Y_\Sigma\cot\theta & Y_\Delta\cot\theta \\ -Y_\Sigma\csc\theta & -Y_\Delta\cot\theta & Y_\Sigma\cot\theta \end{pmatrix}\cdot\begin{pmatrix} V_2 \\ V_3 \\ V_4 \end{pmatrix} \quad 1b$$

where $Y_\Sigma = Y_O + Y_E$ and $Y_\Delta = Y_O - Y_E$

Now assume that there is an identical termination connected to the each of the balanced ports, P1, P2 of FIG. 3, where $Y_B$ is the admittance of each of these identical terminations.

Also define $Y_U$ as the admittance presented by the balun at the unbalanced port P3.

Under the above circumstances, the following identity can be derived:

$$\left[2jY_U - \left(Y_\Sigma - \frac{Y_\Delta^2}{2Y_\Sigma}\right)\cot\theta\right] \times [2jY_B + Y_\Sigma\cot\theta] = \frac{-Y_\Delta^2}{2\sin^2\theta} \quad 2$$

Separating the real and imaginary parts of equation 2 leads to the following two results $$\mathrm{Im}(Y_B) = A\cot\theta \quad 3a$$

$$\text{where } A = \frac{Y_\Sigma}{2} - \left(Y_\Sigma - \frac{Y_\Delta^2}{2Y_\Sigma}\right)\frac{\mathrm{Re}(Y_B)}{2Y_U} \quad 3b$$

$$\tan\theta = \sqrt{\frac{Y_\Delta^2/2 - K^2\mathrm{Re}(Y_B)/Y_U}{4Y_U\mathrm{Re}(Y_B) - Y_\Delta^2/2}} \quad 4a$$

$$\text{where } K = Y_\Sigma - \frac{Y_\Delta^2}{2Y_\Sigma} \quad 4b$$

Equation 3a is an expression for the susceptance of the identical terminations at the balanced ports P1, P2 of FIG. 3 in terms of the admittances $Y_U$, $Y_\Delta$, $Y_\Sigma$ and the real part of the admittance $Y_B$. Equation 4a is an expression relating the phase length θ of each of the coupled line sections of FIG. 3 at the centre frequency of the operating band of the balun to the admittances $Y_U$, $Y_\Delta$, $Y_\Sigma$ and the real part of the admittance $Y_B$.

Now consider the particular case where port P3 of the balun should present a single ended impedance of 50 Ω and where the real part of the termination at each of the balanced ports is 25 Ω—these conditions would apply in the case where the balun was required to convert a single ended input with an optimum terminating impedance of 50 Ω to a differential output with an optimum differential terminating impedance of 50 Ω.

For typical values of $Y_O$ and $Y_E$ (for example $Y_O$=0.2 Siemens and $Y_E$=0.0125 Siemens), the denominator equation 4a remains finite and has the same order of magnitude as the numerator of equation 4a. Thus, the expression tan(θ) is close to unity and hence the phase length θ of each of the coupled line sections of FIG. 3 is less than 90°.

Furthermore, in this case, the expression for A of equation 3b can be simplified as follows:

$$A = \frac{Y_\Delta^2 - Y_\Sigma^2}{2Y_\Sigma}$$

Since $Y_\Sigma > Y_\Delta > 0$, the right hand side of equation 5 must be negative, and hence the variable A is also negative.

Also, since cot(θ) is positive for $0<\theta<90°$, it is clear from equation 3a that the susceptance of the terminations at each of the balanced ports P1, P2 of FIG. 3 must be negative. Hence, it can be concluded that the optimum differential load on the balanced ports P1, P2 of FIG. 3 will be inductive for the case where the balun of FIG. 3 is required to convert a single ended input with an optimum terminating impedance of 50 Ω to a differential output with an optimum differential terminating impedance of 50 Ω.

The invention claimed is:

1. A distributed backwards-wave balun comprising first and second pairs of coupled transmission line sections having one line section of the first coupled pair connected in series with one line section of the second coupled pair, a differential port connected across the outer ends of the series-connected line sections, and a single-ended port connected to the inner end of the other line section of one of the coupled pairs, the balun further including an inductive load connected to each terminal of the differential port, wherein the electrical length of each coupled line section is less than one quarter of the wavelength of the centre frequency of an operating band of the balun such that within said operating band the electrical characteristics of the balun including the inductive load are substantially the same as the electrical characteristics of the balun absent said inductive load but whose coupled line sections have an electrical length equal to said one quarter wavelength.

2. The balun as claimed in claim 1, wherein the or each inductive load is a distributed element.

3. The balun as claimed in claim 1, wherein a single inductive load is connected in parallel across the terminals of the differential port of the balun.

4. The balun as claimed in claim 1, wherein a respective series inductive load is connected to each terminal of the differential port of the balun.

5. The balun as claimed in claim 1, wherein a respective shunt inductive load is connected to each terminal of the differential port of the balun.

6. The balun as claimed in claim 1, wherein the or each inductive load is a lumped component.

* * * * *